US010427838B1

(12) United States Patent
Haessig

(10) Patent No.: US 10,427,838 B1
(45) Date of Patent: Oct. 1, 2019

(54) ERGONOMIC BOWL THAT REDUCES STRESS ON WRISTS

(71) Applicant: Gerald Haessig, New Orleans, LA (US)

(72) Inventor: Gerald Haessig, New Orleans, LA (US)

( * ) Notice: Subject to any disclaimer, the term of this patent is extended or adjusted under 35 U.S.C. 154(b) by 2 days.

(21) Appl. No.: 15/840,889

(22) Filed: Dec. 13, 2017

(51) Int. Cl.
*B65D 25/28* (2006.01)
*A47G 19/02* (2006.01)

(52) U.S. Cl.
CPC ..... *B65D 25/2888* (2013.01); *A47G 19/02* (2013.01)

(58) Field of Classification Search
CPC ..... B65D 25/00–2888; A47G 19/00–022
USPC ..... 220/574–575, 696, 710.5, 752, 753
See application file for complete search history.

(56) References Cited

U.S. PATENT DOCUMENTS 2,293,483 A * 8/1942 Allenby ..... A47J 31/043 215/396
2,661,609 A * 12/1953 Revell ..... A47G 19/22 220/710.5
2,822,107 A * 2/1958 Regan ..... A01J 11/06 220/212.5
5,542,577 A * 8/1996 Friedrich ..... A47G 19/04 220/574.1
D427,583 S * 7/2000 Kazama ..... D14/218
D427,853 S 7/2000 Kohlhase
D460,322 S * 7/2002 Orr ..... D7/510
2013/0233868 A1* 9/2013 Benishai ..... A47J 43/24 220/661
2014/0326723 A1* 11/2014 Scharfe ..... A47G 19/2283 220/23.83
2015/0351565 A1* 12/2015 Scharfe ..... A47G 19/06 220/575
2017/0065111 A1 3/2017 Phipps

* cited by examiner

*Primary Examiner* — Kareen K Thomas

(74) *Attorney, Agent, or Firm* — Sanchelima & Associates, P.A.; Christian Sanchelima; Jesus Sanchelima

(57) ABSTRACT

The present disclosure discloses a bowl. The bowl comprises a container and at least two flanges provided at opposite ends of the container. The at least two flanges are designed such that a user of the bowl can lift the bowl by grasping one of the flanges with minimum wrist movement.

11 Claims, 4 Drawing Sheets

ERGONOMIC BOWL THAT REDUCES STRESS ON WRISTS

BACKGROUND OF THE INVENTION

Other Related Applications

The present application does not claim priority from any other application.

Field of the Invention

The present invention relates to a bowl such as a mixing bowl, drinking cup, or the like. More particularly, the present invention relates to a bowl comprising handles provided at both sides that are used to lift the bowl.

Description of the Related Art

It is known that a bowl includes a container to hold liquid such as water, coffee, beverage, food items, and so on. In one instance, in order to consume a beverage a user may have to hold and lift the bowl. At times, holding the bowl can be uncomfortable. Specifically, when the beverage is hot or cold or when having wrist injuries, it is very difficult to hold the bowl.

In order to overcome the problem of holding the bowl, a handle is provided at one side or two sides of the bowl. The handle may be used to grasp the bowl without exposing hand of the user to high temperature or condensed moisture of the beverage in the bowl.

Several designs of handles used for grasping the bowl have been proposed in the past. None of them, however, disclose a drinking cup with a handle that is ergonomically designed which users with arthritis or carpal tunnel can use.

Applicant believes that a related reference corresponds to a U.S. Design Pat. No. USD427853 issued to Jens Kohlhase. Further, the Applicant believes that a related reference corresponds to a U.S. Design Pat. No. USD460322 issued to James D Orr et al. Furthermore, the Applicant believes that a related reference corresponds to a United States Patent Application No. 20170065111 by Troy Hunter Phipps et al. However, the references differ from the present invention because USD427853 discloses a thermal mug comprising a semicircular handle coupled to the container at one end. Further, USD460322 and 20170065111 disclose a drinking cup having handles provided at both ends of the container. The handles aid in grasping the drinking cup. It should be understood that due to the semicircular or substantially semicircular design of the handles, it is difficult for users with arthritis or carpal tunnel to grasp the drinking cup.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a bowl having a uniquely shaped handle that cooperates with right and left users with minimum wrist movement to grasp or lift the bowl.

It is one object of this invention to provide at least one flange on one side of a container to grasp or lift the bowl.

It is another object of the present invention to provide at least two flanges at opposite sides of the container to help the user to grasp the bowl with one or both hands.

It is yet another object of this invention to provide a bowl comprising flanges that are uniquely designed to aid the users with arthritis or carpal tunnel to lift the bowl with minimal wrist movement.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a bowl comprising uniquely designed handle used to lift the drinking cup. Specifically, the handle comprises at least one flange provided at one side of a container of the bowl. In one example, the handle may comprise at least two flanges provided at opposite ends of the container. The flanges are designed such that a user of the bowl can lift the bowl by the grasping the flange with minimum wrist movement. The flanges can have a downward slope towards the base member. The second flange has a straight configuration and includes a proximal portion, middle portion, and distal portion and the proximal and distal portions have a width greater than the middle portion to allow a user a recess to receive the space between a user's thumb and index finger. The first flange can have a distal end that extends until the meeting point between the upper and bottom halves of the bowl.

Various features and embodiments of the bowl are explained in conjunction with the description of FIGS. 1-4B.

Figure 1:
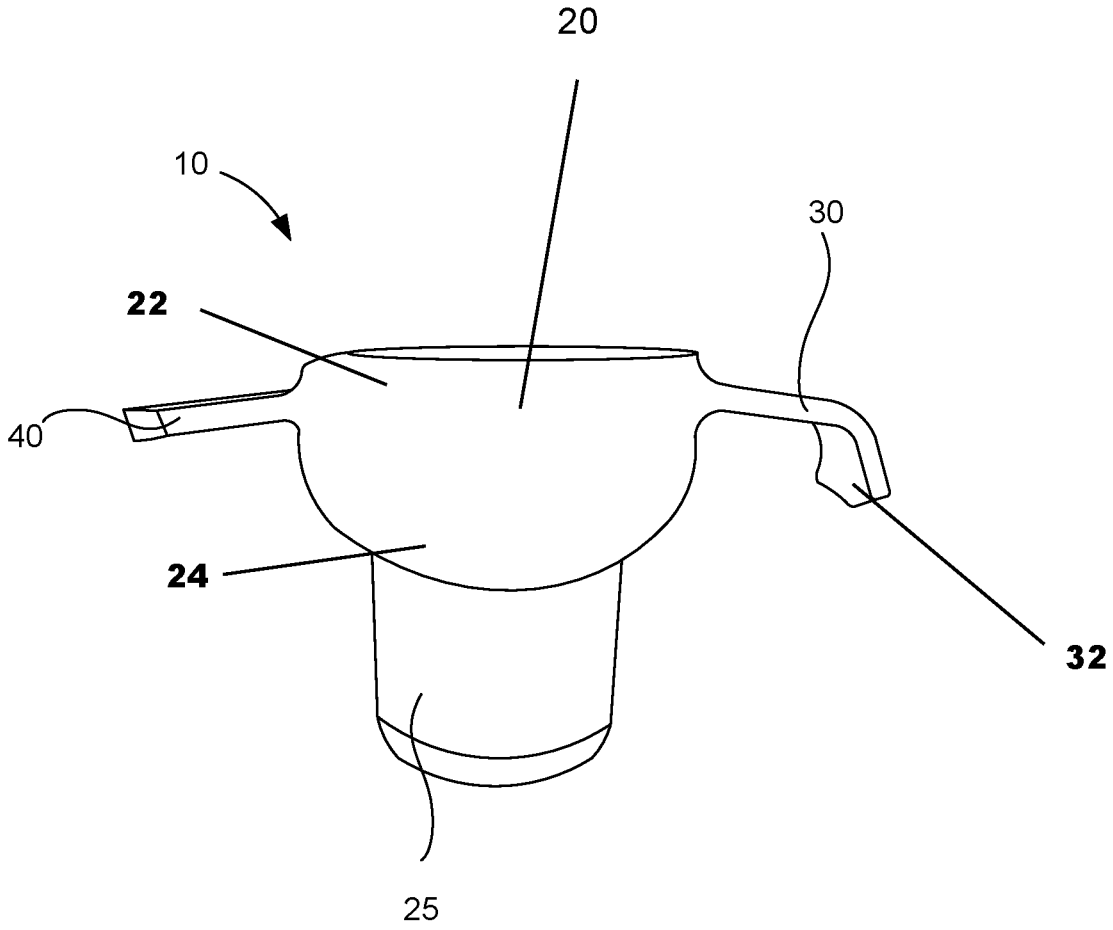
FIG. 1 illustrates a front view of a bowl, in accordance with one embodiment of the present disclosure.

Referring now to FIG. 1, a front view of a bowl 10 is shown, in accordance with one embodiment of the present disclosure. The bowl 10 comprises a container 20. The container 20 is used to hold liquid substances such as water, food items, soda, beverage, and so on. It should be understood that the container 20 might be provided in any shape. In one example, the container 20 may be provided in cylindrical shape. In another example, the container 20 may be provided in square or rectangular shape. It should be understood that the container 20 might be provided in any shape having a base to rest on surface. The container 20 may be made up of stainless steel, ceramic, plastic or any other suitable material that is capable of holding hot or cold beverages, foods, and the like. Bowl 10 can include an integrally and centrally mounted base member 25 that can include a flat surface to support bowl 10 on a horizontal surface. In one embodiment, base member 25 can have a cylindrical configuration.

Figure 2:
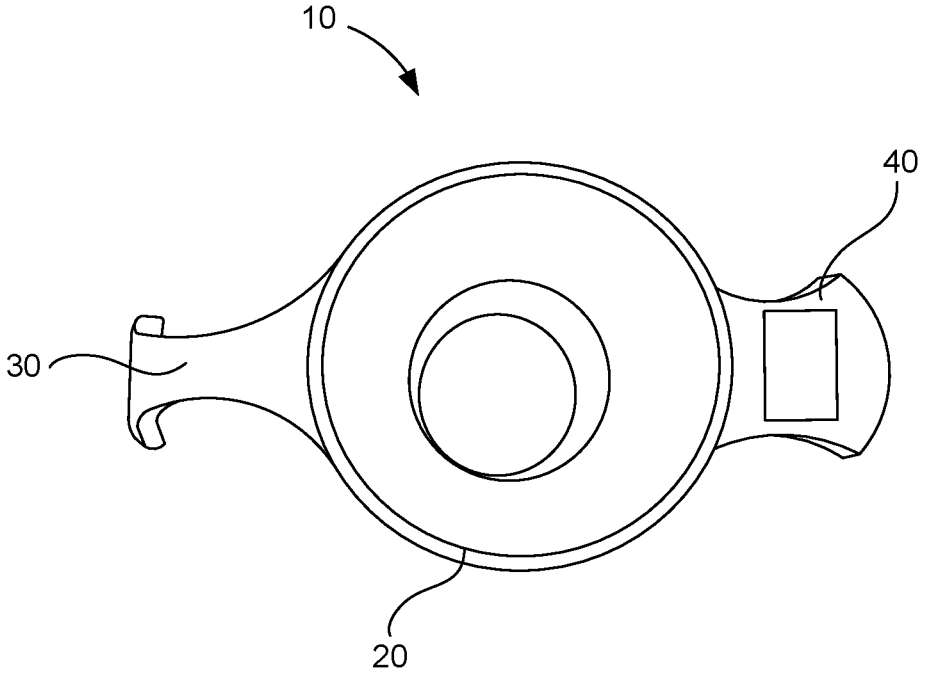
FIG. 2 illustrates a top view of the bowl, in accordance with one embodiment of the present disclosure.

In one embodiment, the bowl 10 may comprise at least one handle formed with the container 20. Referring to FIG. 2, a top view of the bowl 10 is shown. As can be seen from FIGS. 1 and 2, the bowl 10 comprises a pair of handles i.e., a first flange 30 and a second flange 40. In one example, the first flange 30 and the second flange 40 are provided as an integral part of the container 20. Further, the first flange 30 and the second flange 40 are provided at opposite sides of the container 20 and can be positioned 180 degrees apart. In one implementation, the first flange 30 and the second flange 40 may be positioned between 90-180 degrees apart and such implementation is within the scope of the present disclosure.

Figure 3A:
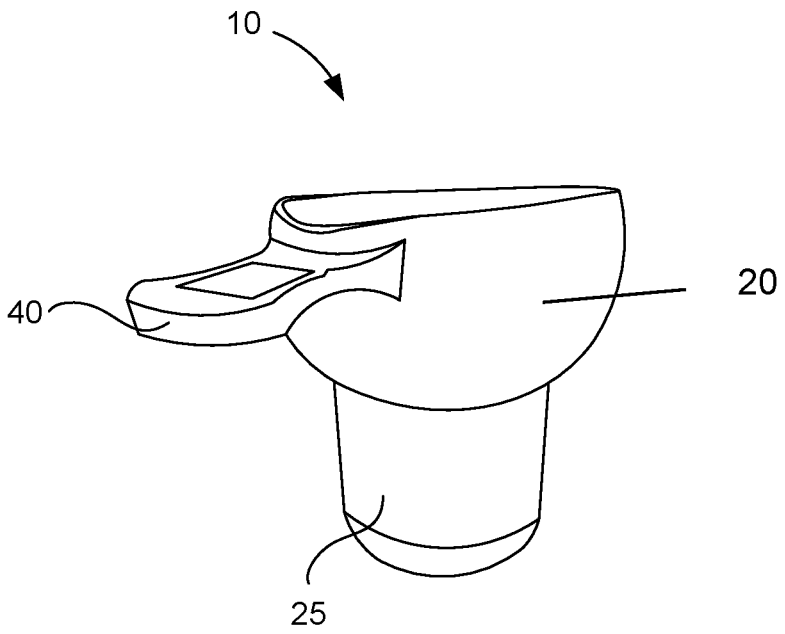
FIGS. 3A and 3B illustrate the bowl comprising a first flange and a second flange, respectively, in accordance with one embodiment of the present disclosure.

Referring to FIG. 3A, a perspective view of the bowl 10 showing the first flange 30 is shown, in accordance with one embodiment of the present disclosure. The first flange 30 may be mounted to upper half 22 and provided at substantially right angle with respect to the container 20. In one example, the first flange 30 may be provided as an integral part of the container 20 to define as a one-piece unit. In another example, the first flange 30 may be provided as a removable external component and is coupled to the container 20 using known mechanical means. First flange 30 has a distal end 32 that curves downwards towards base member 25 creating an obtuse angle or 90-degree angle.

Figure 3B:
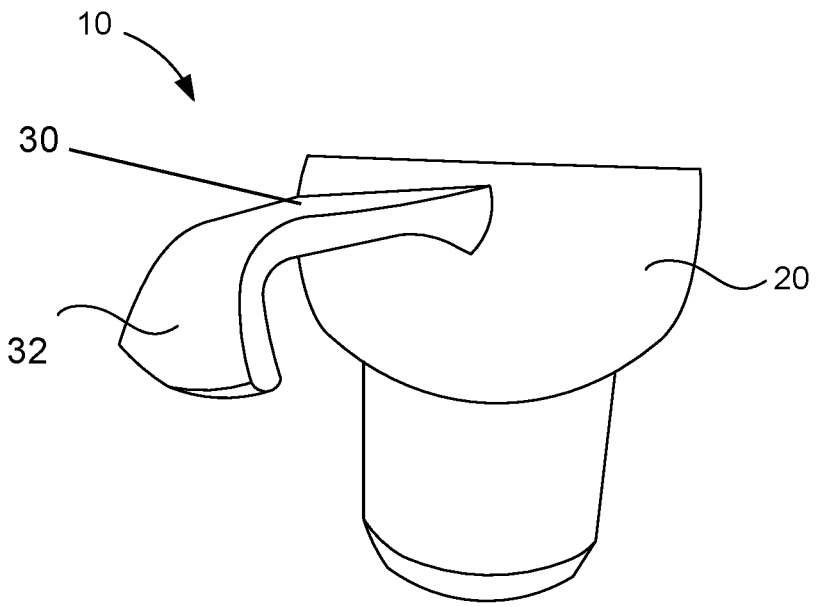

Similarly, referring to FIG. 3B, a perspective view of the bowl 10 showing the second flange 40 is shown, in accordance with one embodiment of the present disclosure. The second flange 40 may be provided at substantially right angle with respect to the container 20. In one example, one end of the second flange 40 is connected to the container 20. Further, the distal end of the first flange 30 includes distal end 32 that is angled downwardly with respect to first flange 30 such that users with arthritis or carpal tunnel are able to hold the first flange 30 and use the bowl without having to bend their wrists. In one example, the first flange 30 may be provided as an integral part of the container 20 to define as a one-piece unit. In another example, the first flange 30 may be provided as an external component and is coupled to the container 20 using known mechanical means. As shown in FIGS. 1 and 3B, distal end 32 is integrally mounted to first flange 30.

Figure 4A:
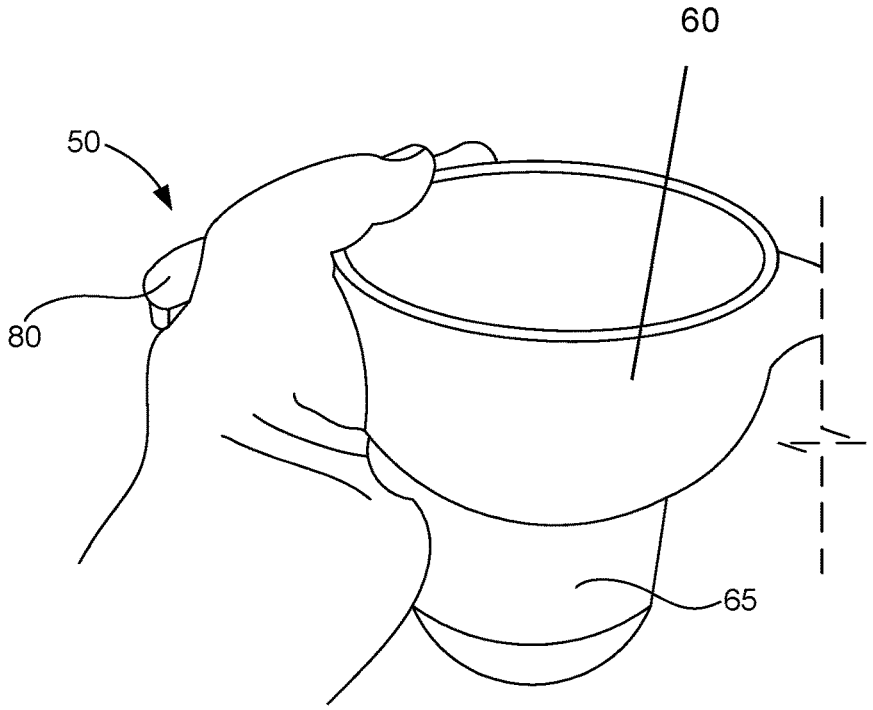
FIGS. 4A and 4B illustrate a user holding the bowl, in accordance with one exemplary embodiment of the present disclosure.
Figure 4B:
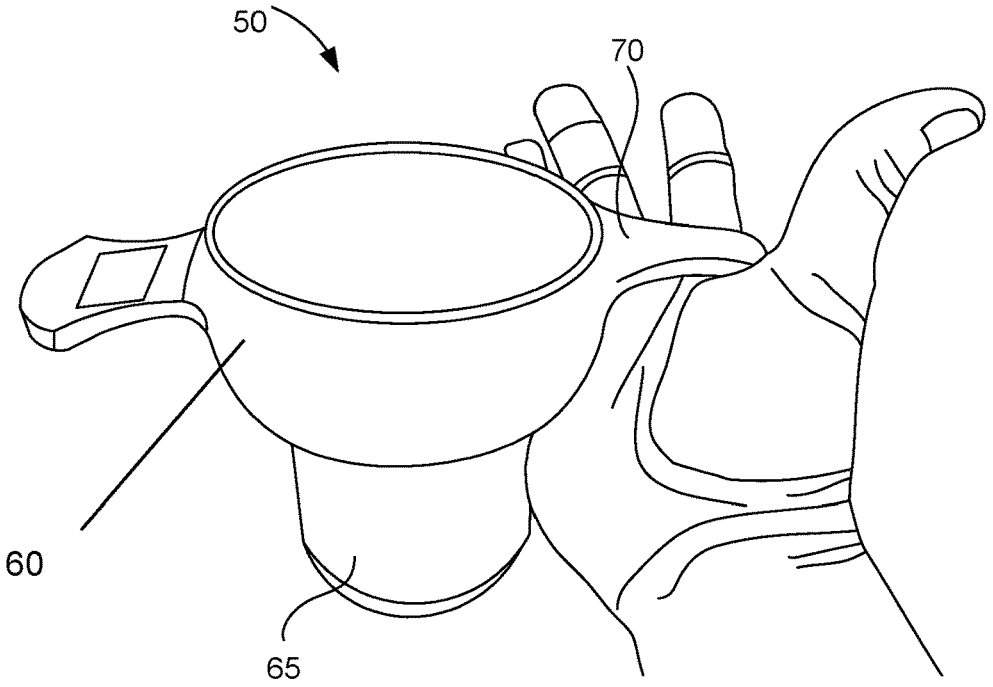

Referring to FIGS. 4A and 4B, the user holding a bowl 50 is explained, in accordance with one exemplary embodiment of the present disclosure. The bowl 50 comprises a container 60 (similar to container 20) and a first flange 70 (similar to the first flange 30). As can be seen in FIG. 4A, the user holding the bowl 50 with left hand is shown. Specifically, the user holds the bowl 50 by grasping the first flange 70 with left hand. Similarly, the bowl 50 comprising a second flange 80 (similar to second flange 40) is shown in FIG. 4B. In order to hold or lift the drinking cup 50, the user may grasp the first flange 70. Due to bent surface provided on one end of the first flange 70, the user is able to hold the drinking cup firmly with minimum wrist movement. Bowl 50 can include an integrally and centrally mounted base member 65 that can include a flat surface to support bowl 50 on a horizontal surface. In one embodiment, base member 65 can have a cylindrical configuration.

Due to design of the flanges as explained above, the user with arthritis or carpal tunnel may use the drinking cup with minimum wrist movement. It is apparent from the above description that the user may grasp either the first flange 30 or the second flange 40 with one hand or use both the first flange 30 and the second flange 40 with two hands to lift the drinking cup 10. Further, it should be understood that one or more flanges than the depicted first flange 30 and the second flange 40 may be provided on the container 20 to aid the users to grasp the bowl 10 with minimum wrist movement.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A bowl, comprising:

a. a container having a bottom, an outer circumference divided between an upper half and a bottom half;

b. a curved flange having a curved flange proximal end having a curved flange proximal width and is mounted perpendicularly to said upper half, said curved flange includes a curved flange bridge that connects said proximal end with a curved flange distal end;

c. said curved flange bridge includes a curved flange bridge width, said curved flange proximal end includes a curved flange proximal end width that is greater than said curved flange bridge width, said curved flange distal end includes a curved flange distal end width that is greater than said curved flange bridge width, said curved flange bridge also includes two lateral sides that are concave and each define a nook adapted to receive a purlicue of a user's hand, thereby permitting a user to ergonomically rotate said bowl towards themselves; and d. said curved flange distal end curves downwards towards the bottom of said container.

2. The bowl of claim 1 including a base member integrally and centrally mounted below said bowl-shaped container.

3. The bowl of claim 2 wherein said base member is cylindrical.

4. The bowl of claim 2 wherein said base member has a flat bottom surface.

5. The bowl of claim 1 wherein said curved flange distal end has a first length and the curved flange bridge of said curved flange has a second length, said first length is less than said second length.

6. The bowl of claim 1 wherein said curved flange is removably mounted to said upper half.

7. The bowl of claim 1 wherein said container is bowl-shaped, square, rectangular or cylindrical.

8. The bowl of claim 1 wherein said distal end extends downwards until it is adjacent to a meeting point between said upper and bottom halves.

9. A bowl, comprising:

a) a container having a bottom, an outer circumference divided between an upper half and a bottom half;

b) a curved flange having a curved flange proximal end having a curved flange proximal width and is mounted perpendicularly to said upper half, said curved flange includes a curved flange bridge that connects said proximal end with a curved flange distal end;

c) said curved flange bridge includes a curved flange bridge width, said curved flange proximal end includes a curved flange proximal end width that is greater than said curved flange bridge width, said curved flange distal end includes a curved flange distal end width that is greater than said curved flange bridge width, said curved flange bridge also includes two lateral sides that are concave and each define a nook adapted to receive a purlicue of a user's hand, thereby permitting a user to ergonomically rotate said bowl towards themselves;

d) said curved flange distal end curves towards the bottom of said container; and e) a straight flange having a straight flange proximal end having a width and mounted to said upper half opposite said curved flange, a straight flange bridge portion extending from said straight flange proximal end, said straight flange bridge portion having a width less than the width of said straight flange proximal end, said straight flange bridge portion including two lateral sides, each of said lateral sides is concave and each creates a nook adapted to receive the purlicue of a user's hand, thereby permitting a user to ergonomically rotate said bowl towards themselves, said straight flange includes a straight flange distal end having a width and flares outwardly from said straight flange bridge portion, said straight flange distal end's width is greater than the width of said straight flange bridge portion.

10. The bowl of claim 9 wherein said straight flange has a grip area on said straight flange bridge portion.

11. A bowl comprising:

a) a container having a bottom, an outer circumference divided between an upper half and a bottom half; and b) a straight flange having a straight flange proximal end having a width and mounted to said upper half opposite said curved flange, a straight flange bridge portion extending from said straight flange proximal end, said straight flange bridge portion having a width less than the width of said straight flange proximal end, said straight flange bridge portion including two lateral sides, each of said lateral sides is concave and each creates a nook adapted to receive a purlicue of a user's hand, thereby permitting a user to ergonomically rotate said bowl towards themselves, said straight flange includes a straight flange distal end having a width and flares outwardly from said straight flange bridge portion, said straight flange distal end's width is greater than the width of said straight flange bridge portion.

* * * * *